US010773778B1

(12) United States Patent
Shaffer et al.

(10) Patent No.: US 10,773,778 B1
(45) Date of Patent: Sep. 15, 2020

(54) LED LIGHTS FOR SURFBOARD

(71) Applicants: Homer Shaffer, Halethorpe, MD (US); Michele Walter, Halethorpe, MD (US)

(72) Inventors: Homer Shaffer, Halethorpe, MD (US); Michele Walter, Halethorpe, MD (US)

( * ) Notice: Subject to any disclaimer, the term of this patent is extended or adjusted under 35 U.S.C. 154(b) by 0 days.

(21) Appl. No.: 16/601,644

(22) Filed: Oct. 15, 2019

(51) Int. Cl.

| | |
|---|---|
| ***F21V 15/01*** | (2006.01) |
| ***F21V 31/00*** | (2006.01) |
| ***F21V 23/02*** | (2006.01) |
| ***F21V 23/04*** | (2006.01) |
| ***B63B 32/00*** | (2020.01) |
| ***F21Y 105/18*** | (2016.01) |
| ***B63B 45/02*** | (2006.01) |
| *F21Y 115/10* | (2016.01) |

(52) U.S. Cl.
CPC ..... *B63B 45/02* (2013.01); *B63B 32/00* (2020.02); *F21V 15/01* (2013.01); *F21V 23/02* (2013.01); *F21V 23/04* (2013.01); *F21V 31/005* (2013.01); *B63B 2201/08* (2013.01); *F21Y 2105/18* (2016.08); *F21Y 2115/10* (2016.08)

(58) Field of Classification Search
CPC ..... B63B 45/02; B63B 32/00; F21V 15/01; F21V 23/02; F21V 23/04; F21V 31/005
See application file for complete search history.

(56) References Cited

U.S. PATENT DOCUMENTS

| | | | | |
|---|---|---|---|---|
| 7,238,075 | B2 * | 7/2007 | Brodsky | B63B 45/04 441/80 |
| 7,811,144 | B2 | 10/2010 | Cavanaugh | |
| 8,882,554 | B2 | 11/2014 | McKinney | |
| 9,108,707 | B2 | 8/2015 | Pradeep | |
| 9,969,469 | B1 * | 5/2018 | Bell | H05B 45/10 |
| 10,060,591 | B2 | 8/2018 | Voaklander | |
| 10,195,347 | B1 * | 2/2019 | Berkman | A61M 5/31 |
| 2010/0048071 | A1 * | 2/2010 | Nascimento | B63B 45/02 441/74 |
| 2015/0217675 | A1 | 8/2015 | Dayan | |
| 2017/0225754 | A1 | 8/2017 | Keddington | |

FOREIGN PATENT DOCUMENTS

| | | |
|---|---|---|
| WO | 2016179666 | 11/2016 |

* cited by examiner

*Primary Examiner* — Mary Ellen Bowman
(74) *Attorney, Agent, or Firm* — Kyle A. Fletcher, Esq.

(57) ABSTRACT

The LED lights for a surfboard is a safety device. The LED lights for a surfboard is configured for use with a surfboard. The surfboard is a floating structure. The surfboard is a roughly disk shaped structure. The surfboard comprises a superior face and an inferior face. The LED lights for a surfboard illuminates when the LED lights for a surfboard is placed in water. The illumination of the LED lights for a surfboard discourages predators in the water from attacking the LED lights for a surfboard. The LED lights for a surfboard comprises a housing, an illumination circuit and the surfboard. The housing contains the illumination circuit. The housing mounts on the inferior face of the disk structure of the surfboard. The illumination circuit automatically illuminates when the LED lights for a surfboard is placed in water.

16 Claims, 7 Drawing Sheets

LED LIGHTS FOR SURFBOARD

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of waterborne vessels including, more specifically, a floating structure adapted for use in sporting or pleasure. (B63B35/73)

SUMMARY OF INVENTION

The LED lights for a surfboard is a safety device. The LED lights for a surfboard is configured for use with a surfboard. The surfboard is a floating structure. The surfboard is a roughly disk shaped structure. The surfboard comprises a superior face and an inferior face. The LED lights for a surfboard illuminates when the LED lights for a surfboard is placed in water. The illumination of the LED lights for a surfboard discourages predators in the water from attacking the LED lights for a surfboard. The LED lights for a surfboard comprises a housing, an illumination circuit and the surfboard. The housing contains the illumination circuit. The housing mounts on the inferior face of the disk structure of the surfboard. The illumination circuit automatically illuminates when the LED lights for a surfboard is placed in water.

These together with additional objects, features and advantages of the LED lights for a surfboard will be readily apparent to those of ordinary skill in the art upon reading the following detailed description of the presently preferred, but nonetheless illustrative, embodiments when taken in conjunction with the accompanying drawings.

In this respect, before explaining the current embodiments of the LED lights for a surfboard in detail, it is to be understood that the LED lights for a surfboard is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the LED lights for a surfboard.

It is therefore important that the claims be regarded as including such equivalent construction insofar as they do not depart from the spirit and scope of the LED lights for a surfboard. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
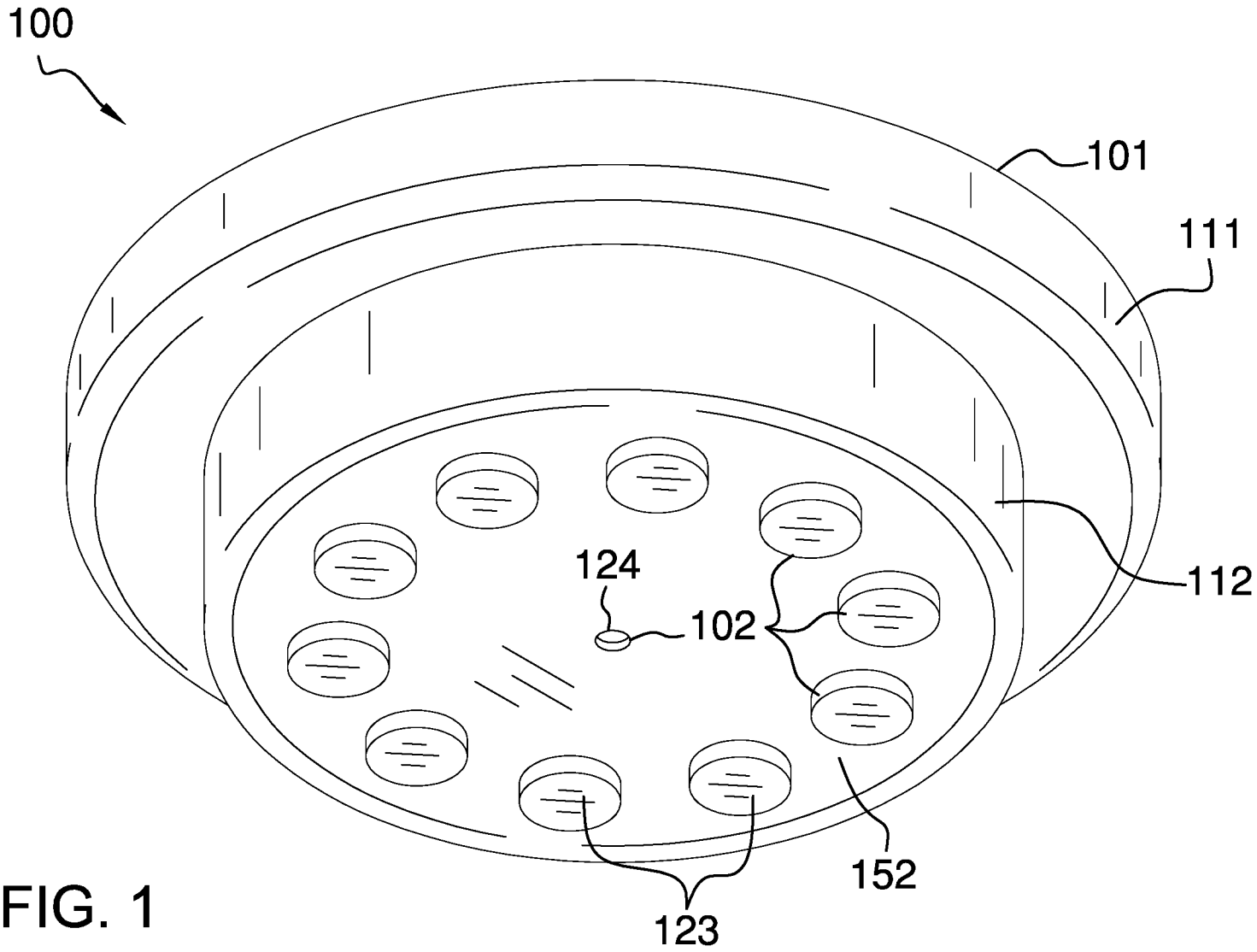
FIG. 1 is a perspective view of an embodiment of the disclosure.
Figure 2:
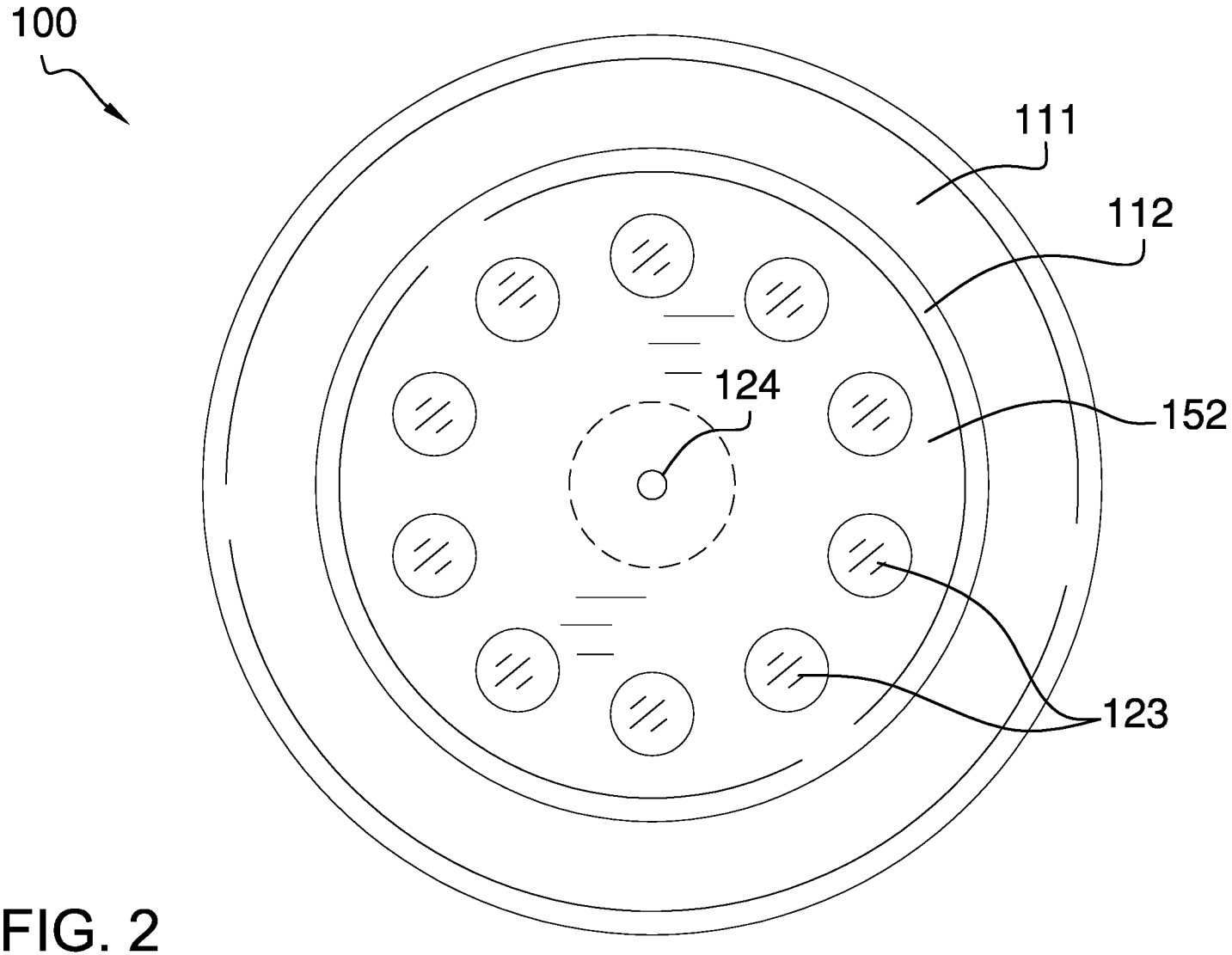
FIG. 2 is a front view of an embodiment of the disclosure.
Figure 3:
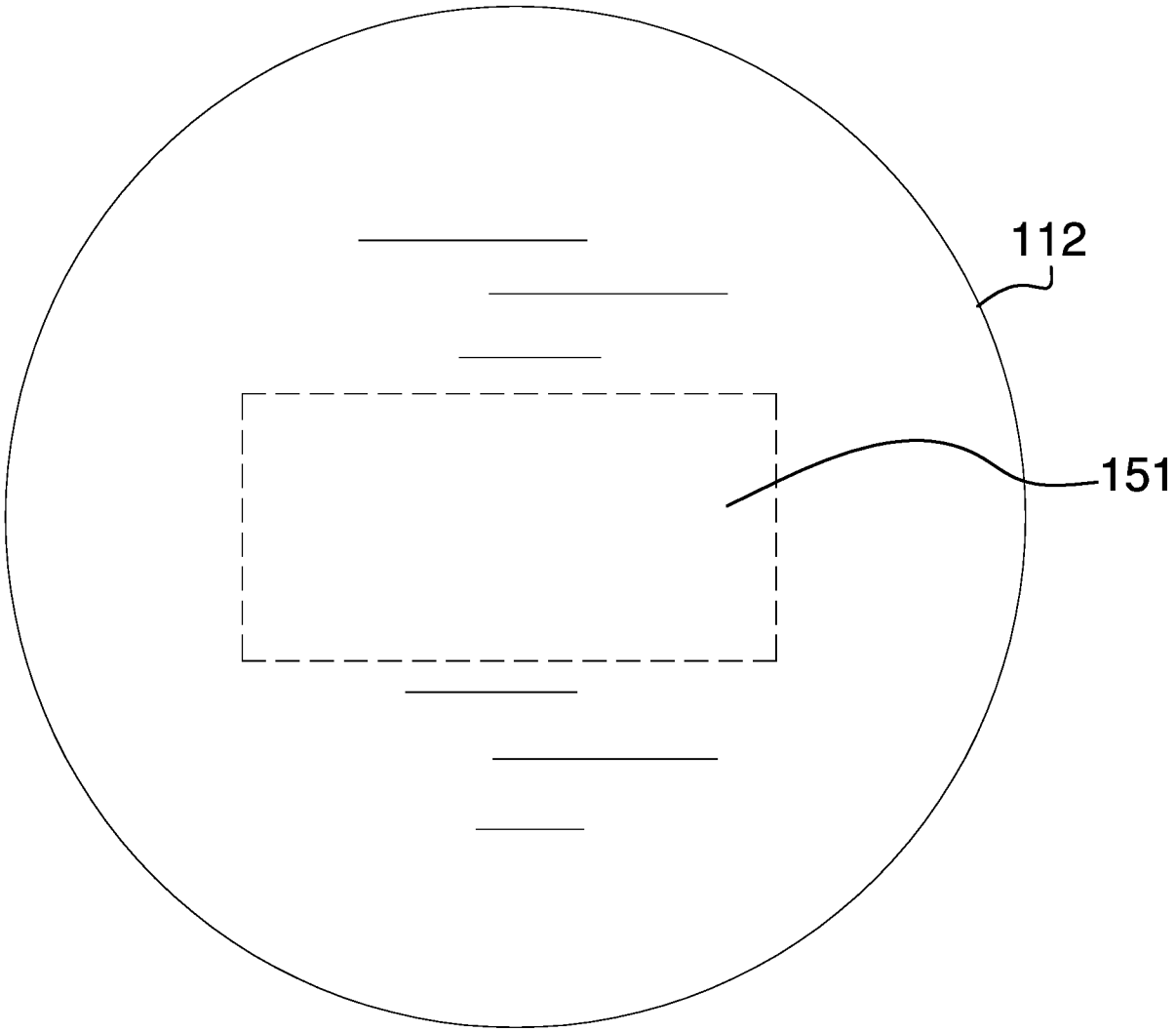
FIG. 3 is a rear view of an embodiment of the disclosure.
Figure 4:
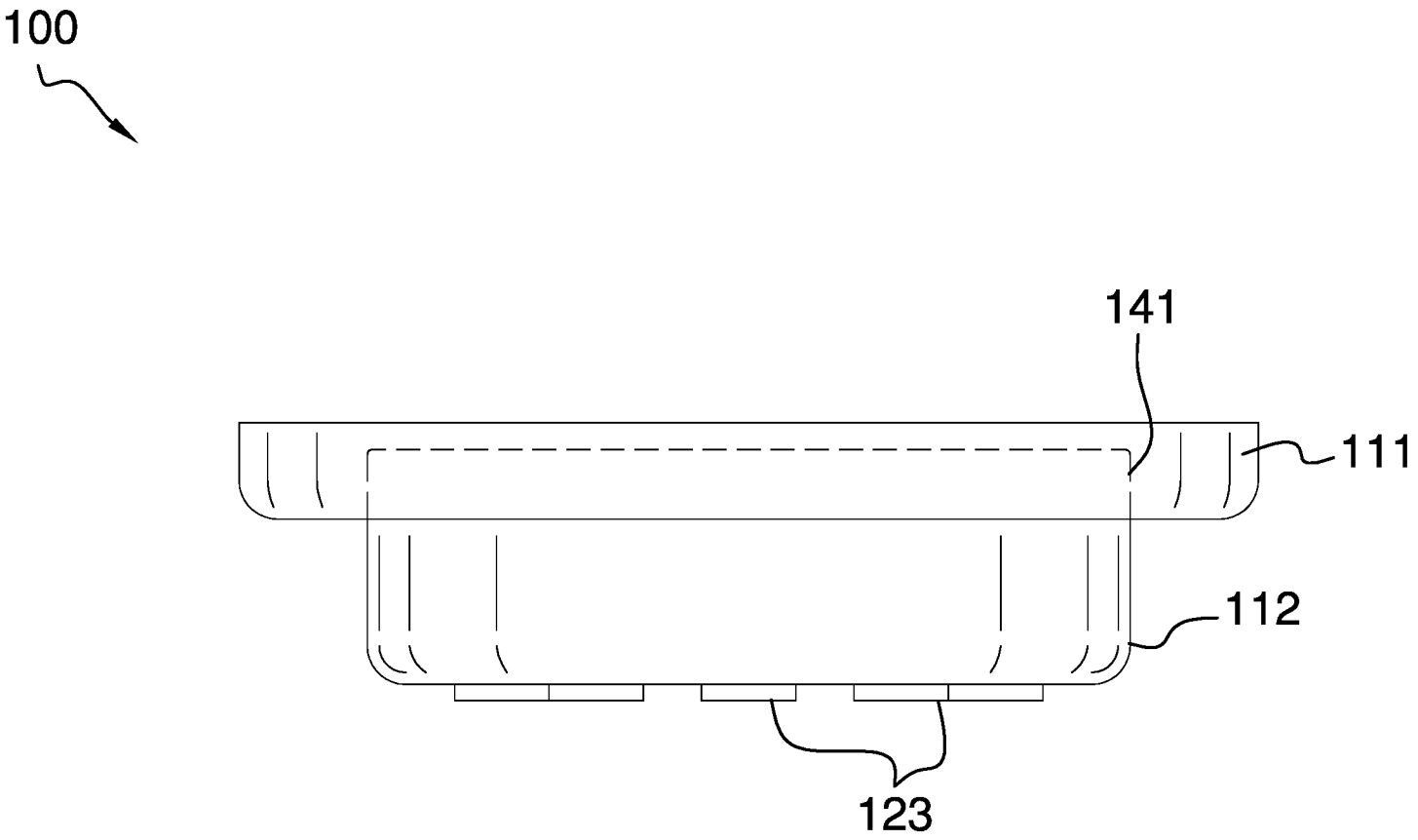
FIG. 4 is a side view of an embodiment of the disclosure.
Figure 5:
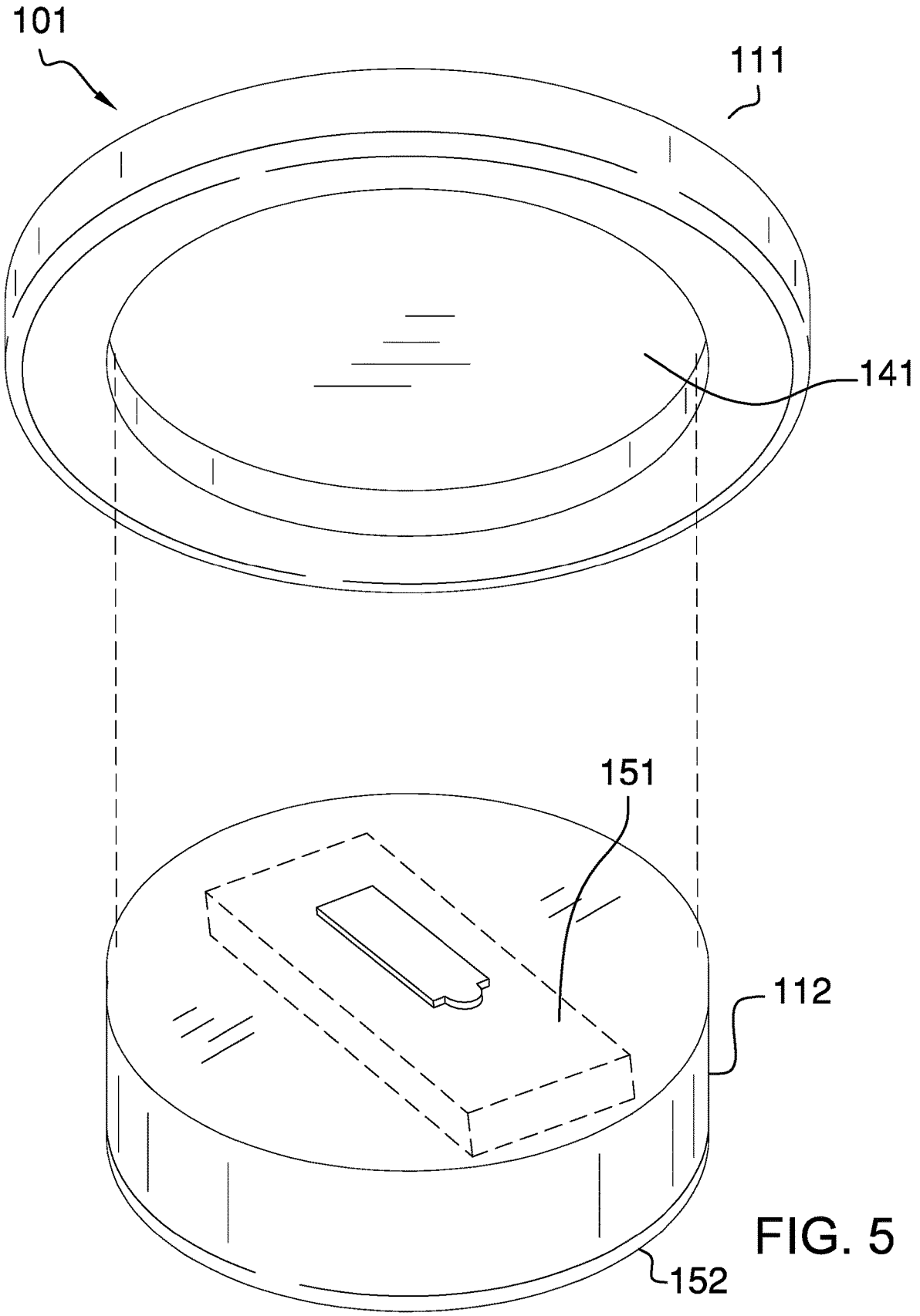
FIG. 5 is an exploded view of an embodiment of the disclosure.
Figure 6:
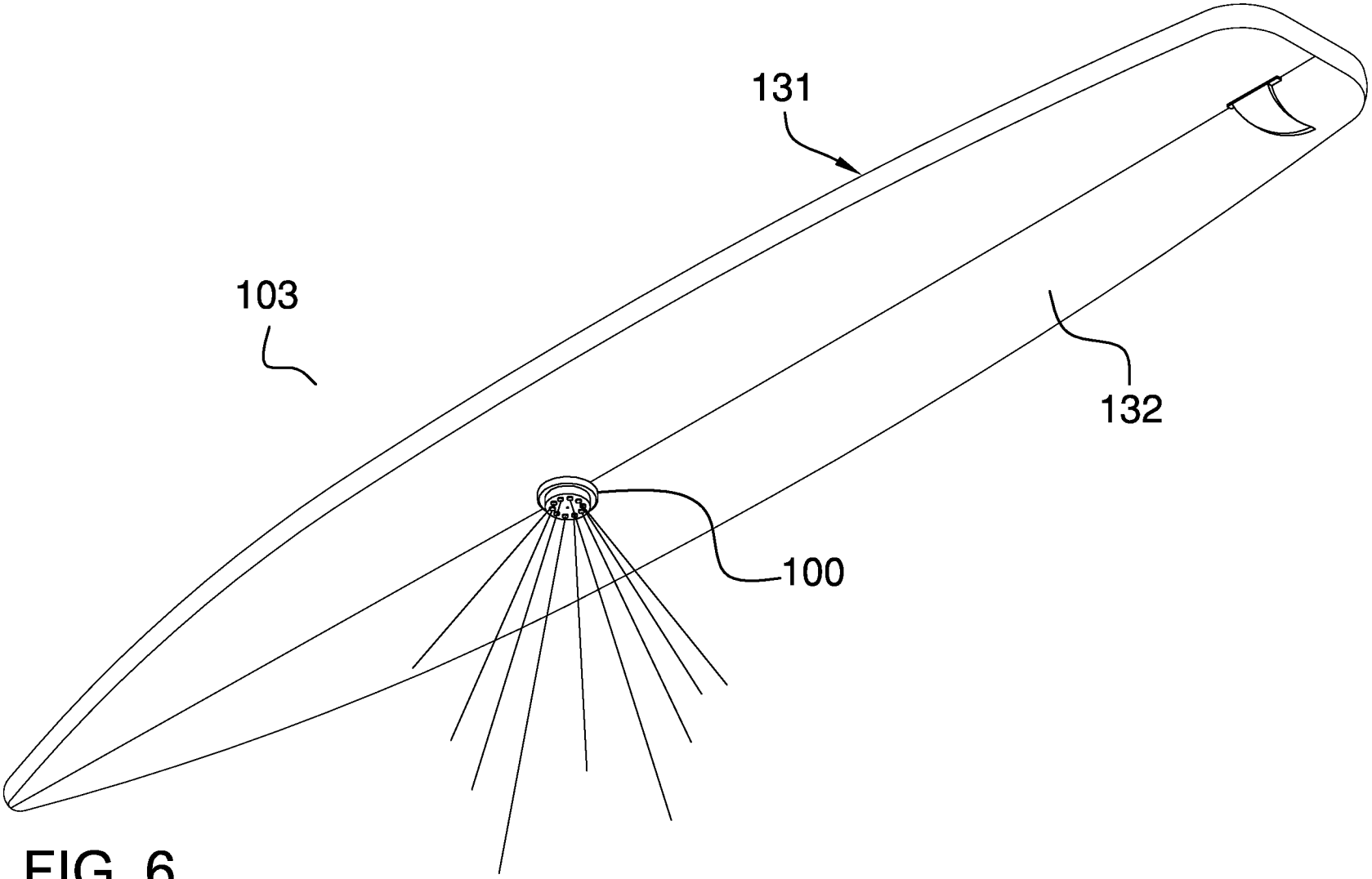
FIG. 6 is an in-use view of an embodiment of the disclosure.
Figure 7:
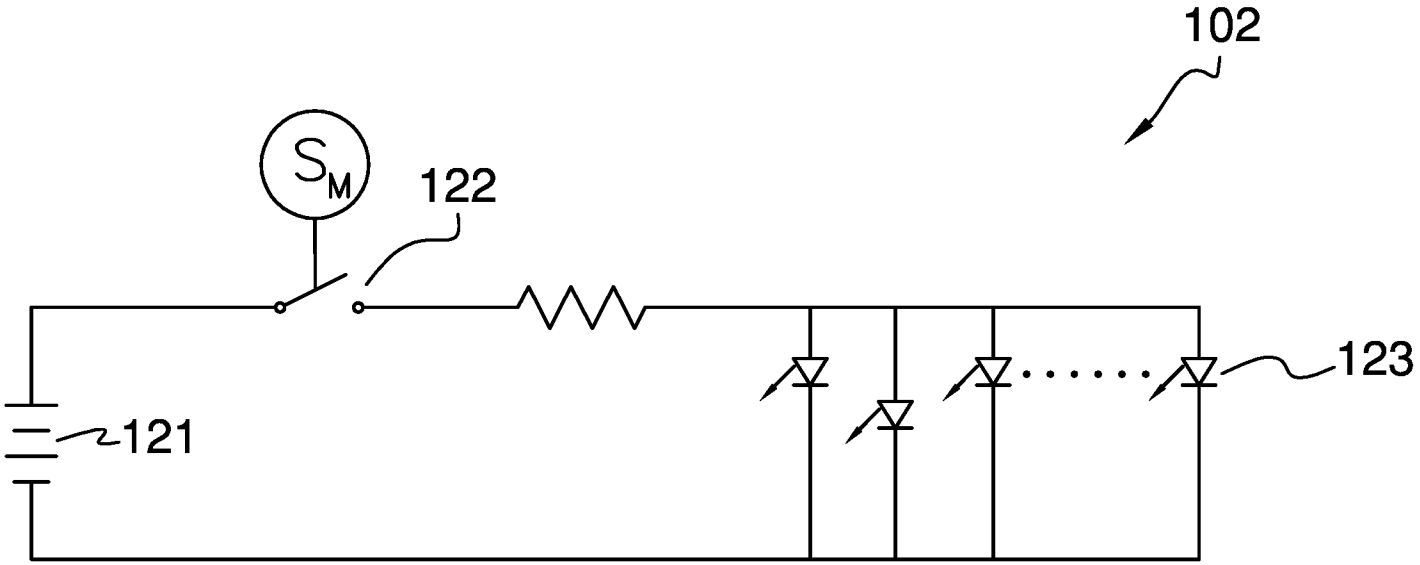
FIG. 7 is a schematic view of an embodiment of the disclosure.

Detailed reference will now be made to one or more potential embodiments of the disclosure, which are illustrated in FIGS. 1 through 7.

The LED lights for a surfboard 100 (hereinafter invention) is a safety device. The invention 100 is configured for use with a surfboard 103. The surfboard 103 is a floating structure. The surfboard 103 is a roughly disk shaped structure. The surfboard 103 comprises a superior face 131 and an inferior face 132. The invention 100 illuminates when the invention 100 is placed in water. The illumination of the invention 100 discourages predators in the water from attacking the invention 100. The invention 100 comprises a housing 101, an illumination circuit 102 and the surfboard 103. The housing 101 contains the illumination circuit 102. The housing 101 mounts on the inferior face 132 of the disk structure of the surfboard 103. The illumination circuit 102 automatically illuminates when the invention 100 is placed in water.

The surfboard 103 is a roughly disk shaped structure. The surfboard 103 floats in a body of water such that the surfboard 103 forms a horizontal platform in the water that is capable of supporting an individual. By supporting an individual is meant that the surfboard 103 is capable of supporting an individual above the superior surface of the water when the individual is resting on the superior face 131 of the surfboard 103. The surfboard 103 is formed with adequate stability to allow the individual to stand on the superior face 131 of the surfboard 103 such that the individual is above the water while the surfboard 103 is freely floating in the water. The superior face 131 forms the superior surface of the surfboard 103 when the surfboard 103 is used normally in the water. The inferior face 132 forms the inferior surface of the surfboard 103 when the surfboard 103 is used normally in the water.

The housing 101 is a rigid structure. The housing 101 has a composite prism shape. The housing 101 contains the illumination circuit 102. The housing 101 attaches the illumination circuit 102 to the inferior face 132 of the surfboard 103. The housing 101 is a fluid impermeable structure. The housing 101 protects the illumination circuit 102 from water damage. The housing 101 is formed with all the apertures and form factors necessary to allow the illumination circuit 102 to operate as described in this disclosure. The housing 101 comprises a mounting disk 111 and a lamp disk 112.

The mounting disk 111 is a disk shaped structure. The lamp disk 112 is a disk shaped structure. The lamp disk 112 attaches to the mounting disk 111 to form a composite prism structure. The composite prism is defined elsewhere in this disclosure. The face of the disk structure of the mounting disk 111 that is distal from the lamp disk 112 attaches to the inferior face 132 of the surfboard 103. The lamp disk 112 inserts into the face of the mounting disk 111 that is distal from the inferior face 132 of the surfboard 103. The lamp disk 112 contains the illumination circuit 102. The lamp disk 112 inserts into the mounting disk 111 to form a fluid impermeable structure. The lamp disk 112 is geometrically similar to the mounting disk 111.

The mounting disk 111 comprises a sealing cavity 141. The sealing cavity 141 is a negative space formed in the face of the disk structure of the mounting disk 111 that is distal from the inferior face 132 of the surfboard 103. The sealing cavity 141 is geometrically similar to the lamp disk 112. The sealing cavity 141 is sized such that the lamp disk 112 inserts into the sealing cavity 141 of the mounting disk 111 to form the composite prism structure of the housing 101. The sealing cavity 141 is sized such that the lamp disk 112 inserts into the sealing cavity 141 to form a water impermeable seal that prevents water from entering the sealing cavity 141 through the space between the lamp disk 112 and the sealing cavity 141.

The lamp disk 112 comprises a battery chamber 151 and an exterior face 152. The exterior face 152 is the face of the disk structure of the lamp disk 112 that is distal from the inferior face 132 of the surfboard 103 when the lamp disk 112 is properly inserted into the sealing cavity 141. The plurality of LEDs 123 and the electrolytic switch 122 are mounted in the exterior face 152 such that the plurality of LEDs 123 and the electrolytic switch 122 have appropriate access to the water. The battery chamber 151 is a negative space that is formed in the face of the disk structure of the lamp disk 112 that is distal from the exterior face 152. The battery chamber 151 is configured to store the battery 121 of the illumination circuit 102 such that the battery 121 is accessible when the lamp disk 112 is removed from the mounting disk 111.

The illumination circuit 102 is an electric circuit. The illumination circuit 102 generates a field of illumination from the inferior face 132 of the surfboard 103 into the water in which the surfboard 103 floats. The illumination circuit 102 automatically initiates the generation of the field of illumination when the illumination circuit 102 senses that the inferior face 132 of the surfboard 103 is placed in the water. The illumination circuit 102 comprises a battery 121, an electrolytic switch 122, a plurality of LEDs 123, and a limit resistor 124. The battery 121, the electrolytic switch 122, the plurality of LEDs 123, and the limit resistor 124 are electrically connected to form a series electric circuit.

The battery 121 is an electrochemical device. The battery 121 converts chemical potential energy into the electrical energy used to power the illumination circuit 102. The battery 121 is a commercially available device.

The electrolytic switch 122 is an electrical device known as an electrolytic switch 122. The electrolytic switch 122 is an electric switch that controls the flow of electricity from the battery 121 to the limit resistor 124. The electrolytic switch 122 is actuated to a closed position when the electrolytic switch 122 is immersed in water. The electrolytic switch 122 is defined elsewhere in this disclosure.

Each of the plurality of LEDs 123 is a two terminal electrical device. Each of the plurality of LEDs 123 generates an illumination when electricity flows through the plurality of LEDs 123. Each of the plurality of LEDs 123 are mounted in the exterior face 152 of the lamp disk 112 such that the illumination generated by the plurality of LEDs 123 generates the field of illumination generated by the invention 100.

The limit resistor 124 is an electric circuit element. The limit resistor 124 is electrically connected in series between the electrolytic switch 122 and the plurality of LEDs 123 such that all the electric current that passes through the plurality of LEDs 123 also flows through the limit resistor 124. The limit resistor 124 limits the amount of electric current that flows through the plurality of LEDs 123.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Battery: As used in this disclosure, a battery is a chemical device consisting of one or more cells, in which chemical energy is converted into electricity and used as a source of power. Batteries are commonly defined with a positive terminal and a negative terminal.

Cavity: As used in this disclosure, a cavity is an empty space or negative space that is formed within an object. See Saucer Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Diode: As used in this disclosure, a diode is a two terminal semiconductor device that allows current flow in only one direction. The two terminals are called the anode and the cathode. Electric current is allowed to pass from the anode to the cathode.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Electrolyte: As used in this disclosure, an electrolyte refers to ionic atomic or polyatomic compounds that dissolve in water to create an electrically conductive solution referred to as an electrolytic solution.

Electrolytic Switch: As used in this disclosure, an electrolytic switch refers to a switching arrangement wherein the electrolytic switch completes the circuit through: 1) The immersion of the electrolytic switch in an electrolytic solution; or, 2) the generation of an electrolytic reaction.

Field of Illumination: As used in this disclosure, a field of illumination refers to an area illuminated by electromagnetic radiation projected from an electrical device such as a lamp or transmission antenna.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Housing: As used in this disclosure, a housing is a rigid structure that encloses and protects one or more devices.

Illumination: As used in this disclosure, light refers to electromagnetic radiation contained with an area. Illumination is a synonym for light, particularly in cases where a measure of the amount of visible electromagnetic radiation in a space is called for.

Inferior: As used in this disclosure, the term inferior refers to a directional reference that is parallel to and in the same direction as the force of gravity when an object is positioned or used normally.

Lamp: As used in this disclosure, a lamp is an electrical device that generates visible light to illuminate objects so they can be seen.

LED: As used in this disclosure, an LED is an acronym for a light emitting diode. A light emitting diode is a diode that is also a light source.

Limit Resistor: As used in this disclosure, a limit resistor is an electrical resistor that is used to limit the flow of electric current through an electrical circuit.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Parallel Circuit: As used in this disclosure, a parallel circuit refers to a method of electrically connecting a plurality of circuit elements to a voltage source. In a parallel circuit each circuit element receives a voltage equal to the full voltage produced by the voltage source.

Perimeter: As used in this disclosure, a perimeter is one or more curved or straight lines that bounds an enclosed area on a plane or surface. The perimeter of a circle is commonly referred to as a circumference.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Resistor: As used in this disclosure, a resistor is a well-known and commonly available electrical device that presents a resistance that inhibits the flow of electricity through an electric circuit. Within an electric circuit processing alternating currents, the resistor will not affect the phase of the alternating current. A current flowing through a resistor will create a voltage across the terminals of the resistor.

Rigid Structure: As used in this disclosure, a rigid structure is a solid structure formed from an inelastic material that resists changes in shape. A rigid structure will permanently deform as it fails under a force.

Roughly: As used in this disclosure, roughly refers to a comparison between two objects. Roughly means that the difference between one or more parameters of the two compared objects are not significantly different.

Series Circuit: As used in this disclosure, a series circuit refers to a method of electrically connecting a plurality of circuit elements to a voltage source. In a series circuit, the proportion of the voltage received by each individual circuit element is divided proportionally between the plurality circuit elements based on the resistance (or impedance) of each circuit element relative to the total resistance of the plurality of circuit elements. The series circuit forms a linear or loop structure often referred to as a daisy chain.

Superior: As used in this disclosure, the term superior refers to a directional reference that is parallel to and in the opposite direction of the force of gravity when an object is positioned or used normally.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Vertical: As used in this disclosure, vertical refers to a direction that is either: 1) perpendicular to the horizontal direction; 2) parallel to the local force of gravity; or, 3) when referring to an individual object the direction from the designated top of The individual object to the designated bottom of The individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A LED lights for a surfboard comprising
a housing, an illumination circuit and a surfboard;
wherein the housing contains the illumination circuit;
wherein the housing mounts on the surfboard;
wherein the LED lights for a surfboard is a safety device;
wherein the LED lights for a surfboard illuminates when the LED lights for a surfboard is placed in water;
wherein the surfboard is a floating structure;
wherein the surfboard is a roughly disk shaped structure;
wherein the surfboard comprises a superior face and an inferior face;
wherein the housing mounts on the inferior face of the disk structure of the surfboard;
wherein the surfboard floats in a body of water such that the surfboard forms a horizontal platform in the water;
wherein the superior face forms the superior surface of the surfboard when the surfboard is used normally in the water;
wherein the inferior face forms the inferior surface of the surfboard when the surfboard is used normally in the water;
wherein the illumination circuit automatically illuminates when the LED lights for a surfboard is placed in water;
wherein the housing is a rigid structure;
wherein the housing has a composite prism shape;
wherein the housing attaches the illumination circuit to the inferior face of the surfboard;
wherein the illumination circuit is an electric circuit;
wherein the illumination circuit generates a field of illumination from the inferior face of the surfboard into the water in which the surfboard floats;
wherein the illumination circuit automatically initiates the generation of the field of illumination when the illumination circuit senses that the inferior face of the surfboard is placed in the water.

2. The LED lights for a surfboard according to claim 1 wherein the housing is a fluid impermeable structure.

3. The LED lights for a surfboard according to claim 2
wherein the housing comprises a mounting disk and a lamp disk;
wherein the lamp disk attaches to the mounting disk to form a composite prism structure;
wherein the lamp disk contains the illumination circuit.

4. The LED lights for a surfboard according to claim 3
wherein the illumination circuit comprises a battery, an electrolytic switch, a plurality of LEDs, and a limit resistor;
wherein the battery, the electrolytic switch, the plurality of LEDs, and the limit resistor are electrically connected to form a series electric circuit.

5. The LED lights for a surfboard according to claim 4 wherein the plurality of LEDs and the electrolytic switch are mounted in the exterior face such that the plurality of LEDs and the electrolytic switch have appropriate access to the water.

6. The LED lights for a surfboard according to claim 5
wherein the mounting disk is a disk shaped structure;
wherein the lamp disk is a disk shaped structure;
wherein the face of the disk structure of the mounting disk that is distal from the lamp disk attaches to the inferior face of the surfboard.

7. The LED lights for a surfboard according to claim 6
wherein the lamp disk inserts into the face of the mounting disk that is distal from the inferior face of the surfboard;
wherein the lamp disk inserts into the mounting disk to form a fluid impermeable structure.

8. The LED lights for a surfboard according to claim 7 wherein the lamp disk is geometrically similar to the mounting disk.

9. The LED lights for a surfboard according to claim 8
wherein the mounting disk comprises a sealing cavity;

wherein the sealing cavity is a negative space formed in the face of the disk structure of the mounting disk that is distal from the inferior face of the surfboard;

wherein the sealing cavity is geometrically similar to the lamp disk.

10. The LED lights for a surfboard according to claim 9 wherein the sealing cavity is sized such that the lamp disk inserts into the sealing cavity of the mounting disk to form the composite prism structure of the housing;

wherein the sealing cavity is sized such that the lamp disk inserts into the sealing cavity to form a water impermeable seal that prevents water from entering the sealing cavity through the space between the lamp disk and the sealing cavity.

11. The LED lights for a surfboard according to claim 10 wherein the lamp disk comprises a battery chamber and an exterior face;

wherein the exterior face is the face of the disk structure of the lamp disk that is distal from the inferior face of the surfboard when the lamp disk is properly inserted into the sealing cavity;

wherein the battery chamber is a negative space that is formed in the face of the disk structure of the lamp disk that is distal from the exterior face;

wherein the battery chamber is configured to store the battery of the illumination circuit such that the battery is accessible when the lamp disk is removed from the mounting disk.

12. The LED lights for a surfboard according to claim 11 wherein the battery is an electrochemical device;

wherein the battery converts chemical potential energy into the electrical energy used to power the illumination circuit.

13. The LED lights for a surfboard according to claim 12 wherein the electrolytic switch is an electric switch that controls the flow of electricity from the battery to the limit resistor;

wherein the electrolytic switch is actuated to a closed position when the electrolytic switch is immersed in water.

14. The LED lights for a surfboard according to claim 13 wherein each of the plurality of LEDs is a two terminal electrical device;

wherein each of the plurality of LEDs generates an illumination when electricity flows through the plurality of LEDs.

15. The LED lights for a surfboard according to claim 14 wherein each of the plurality of LEDs are mounted in the exterior face of the lamp disk such that the illumination generated by the plurality of LEDs generates the field of illumination generated by the LED lights for a surfboard.

16. The LED lights for a surfboard according to claim 15 wherein the limit resistor is an electric circuit element;

wherein the limit resistor is electrically connected in series between the electrolytic switch and the plurality of LEDs such that all the electric current that passes through the plurality of LEDs also flows through the limit resistor;

wherein the limit resistor limits the amount of electric current that flows through the plurality of LEDs.

* * * * *